US005402832A

United States Patent [19]

Kämper et al.

[11] Patent Number: 5,402,832

[45] Date of Patent: Apr. 4, 1995

[54] ENDLESS TEXTILE SLING HAVING BINDING ELEMENTS FOR HOISTING

[75] Inventors: Hans-Werner Kämper, Würselen; Willi Panhausen, Gangelt, both of Germany

[73] Assignee: Spanset Inter AG, Oetwil am See, Switzerland

[21] Appl. No.: 139,119

[22] Filed: Oct. 21, 1993

[30] Foreign Application Priority Data

Oct. 21, 1992 [DE] Germany ..... 9214173 U

[51] Int. Cl.[6] ..... D03D 3/02; D03D 11/02

[52] U.S. Cl. ..... 139/387 R; 139/413; 428/36.1; 428/232

[58] Field of Search ..... 294/74; 139/408, 411, 139/387 R, 388, 413, 414, 415, 390; 428/232, 36.1, 36.2, 175, 181, 182; 138/123; 57/201

[56] References Cited

U.S. PATENT DOCUMENTS 4,015,641 4/1977 Goff, Jr. et al. ..... 139/387 R
5,238,278 8/1993 Kämper .

FOREIGN PATENT DOCUMENTS 0116916 8/1984 European Pat. Off. .
0279950 8/1988 European Pat. Off. .
647904 9/1934 Germany .
2716056 10/1978 Germany .
9114173 1/1993 Germany .
1075841 4/1986 Japan ..... 139/415

*Primary Examiner*—Andrew M. Falik
*Attorney, Agent, or Firm*—Spencer, Frank & Schneider

[57] ABSTRACT

An endless textile sling for lifting. The sling includes a textile protective cover having a first textile tube, and a second textile tube within the first textile tube to form a double tube structure. The first tube and the second tube are connected together along two respective oppositely positioned longitudinal edges to form an inner sheath and an outer sheath. The sling further includes a load-carrying core within the second textile tube. The core includes a plurality of endless fiber strands. The sling is provided with a plurality of binding elements positioned between the two longitudinal edges and connecting the inner and outer sheaths together. The inner and outer sheaths are separated by a space. The binding elements partition the space into mutually separated chambers. The binding elements include one of a binding warp, a tie-in and an interlaced connection.

17 Claims, 7 Drawing Sheets

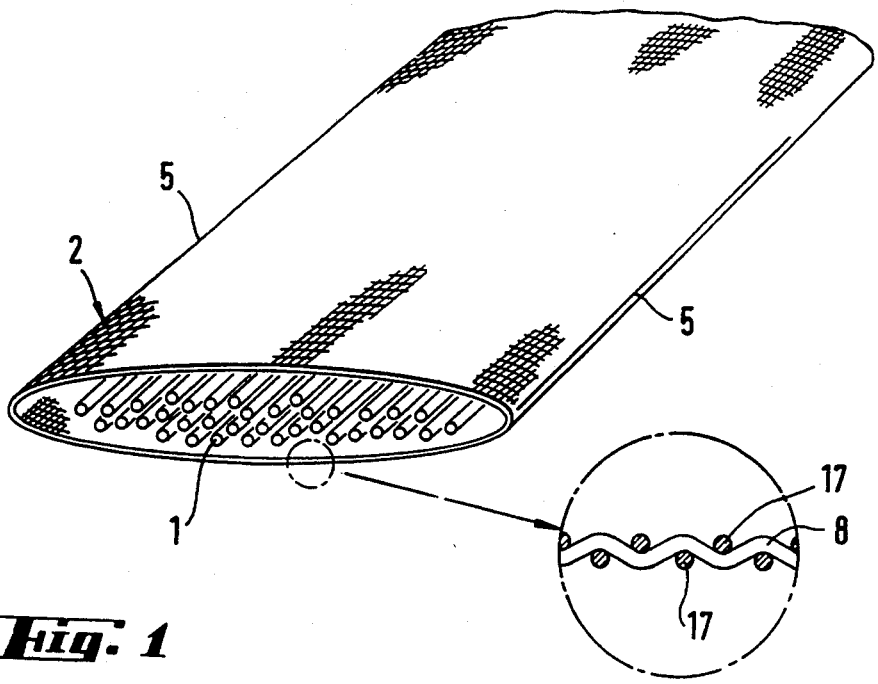
Fig. 1
(Prior Art)
Fig. 1a (Prior Art)
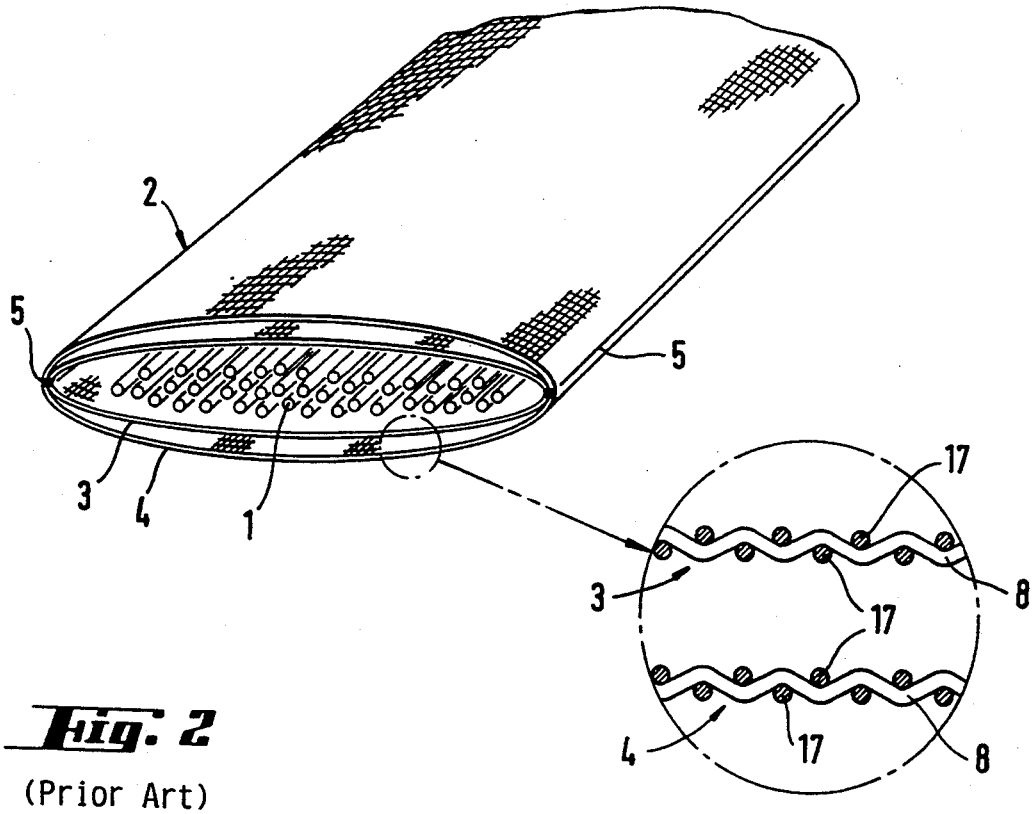
Fig. 2
(Prior Art)
Fig. 2a (Prior Art)

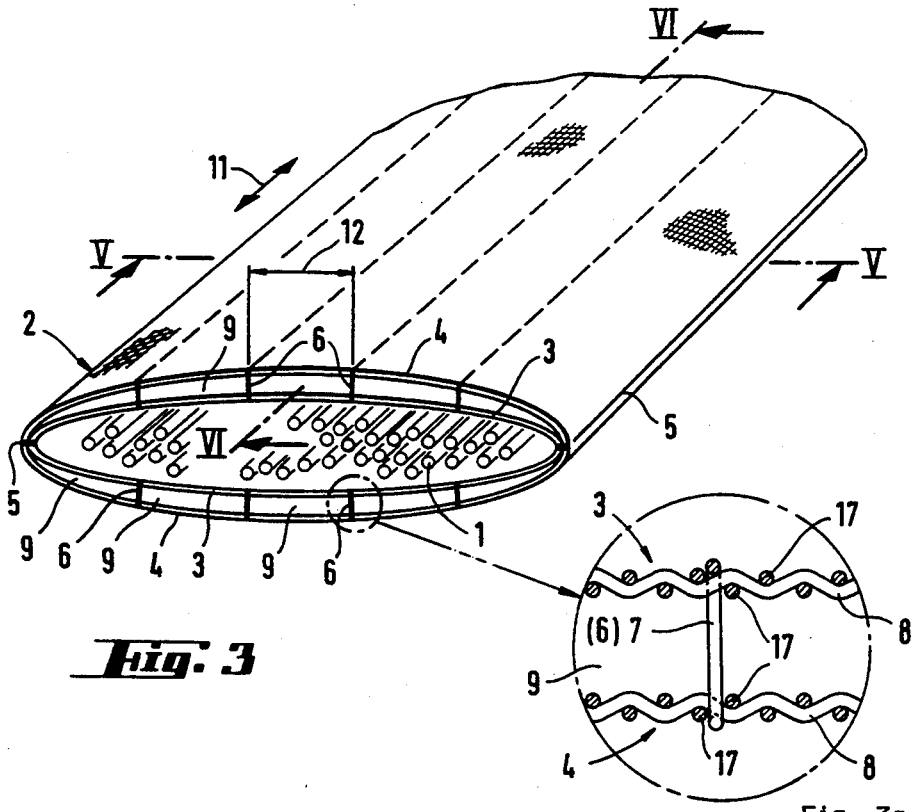
Fig. 3
Fig. 3a (Prior Art)
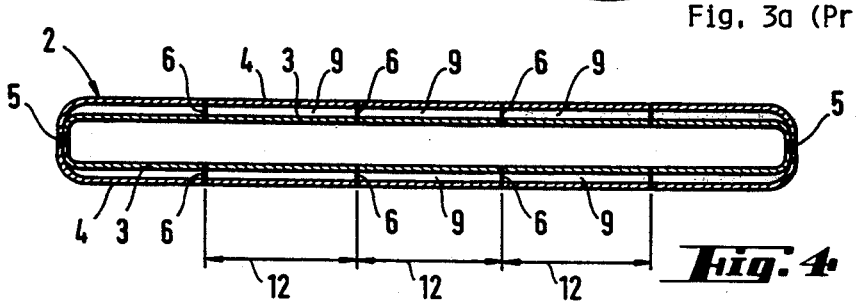
Fig. 4
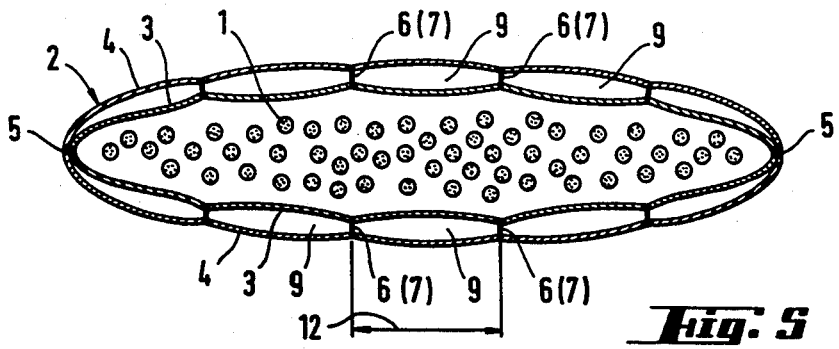
Fig. 5

ENDLESS TEXTILE SLING HAVING BINDING ELEMENTS FOR HOISTING

BACKGROUND OF THE INVENTION

The invention relates to an endless sling having a textile protective cover comprising a first textile tube, and a second textile tube within the first textile tube to form a double tube structure. The first tube and the second tube are connected together along two respective oppositely positioned longitudinal edges to form an inner sheath and an outer sheath. The sling has a load-carrying core within the second textile tube that includes a plurality of endless fiber strands.

Endless slings of the type according to the invention are defined quite generally in DIN [German Industrial Standard] 61360. Their basic structure and manner of fabrication are disclosed in DE-2,716,056.A1. There, normal tubular fabrics are employed for the protective tubes on such endless slings. From a weaving technology aspect, a tubular fabric is a woven band of two layers of fabric which lie on top of one another during weaving, with both their longitudinal edges being connected with one another by the manner in which the weft threads are guided or by a special manner of interlacing them.

For some time, a double-sheathed tube has also been used as the protective tube for such endless slings; in general use, this is called a double tube. Such a double tube is not composed of two boxed, completely separate tubes. Rather, with respect to weaving technology, it constitutes a woven band having four superposed layers of fabric that are produced in one weaving process and are connected with one another, from a textile technology aspect, at both their longitudinal edges basically in the same manner as described above by the manner in which the weft threads are guided or by a specific way of interlacing them. Thus the double tube is given an inner sheath and an outer sheath which, however, are limited to the regions between the two longitudinal edges extending in the longitudinal direction of the tube.

Compared to the conventional single protective tube, the double tube offers certain advantages, among them that of better flexibility and adaptability to the outer contours of the load to be hoisted. In this connection it is assumed that the individual wall thickness of the inner sheath and the outer sheath of the double tube of an endless sling is less in each case than the wall thickness of the single protective tube of an endless sling of the same size.

According to the technical guidelines for abutment means, an endless sling must be discarded as no longer usable if the protective tube is damaged to the extent that the load-carrying fiber strands can be seen through the protective tube, that is, are exposed. According to this definition, an endless sling equipped with a double tube is still usable if only its outer sheath is damaged, while the inner sheath is still intact in this damaged region, that is, the load-carrying fiber strands are completely encased, thus remaining invisible from the outside.

If there is easily visible damage to the outer sheath of an endless sling equipped with a double tube, it is difficult to unequivocally determine whether at least the inner sheath is indeed undamaged. This is particularly difficult if the easily visible damage to the outer sheath developed under load, that is, during use of the endless sling. Due to the stretchability and displaceability of particularly the inner sheath with respect to the outer sheath of such an endless sling, it easily happens under load that the inner sheath is displaced by a few centimeters relative to the outer sheath. If in such a case, not only the outer sheath is damaged but also the inner sheath at the same location, with the latter having been displaced out of its normal position relative to the outer sheath by the action of the load, this damage to the inner sheath can no longer be unequivocally determined or evaluated during the customary visual check in the unloaded state. In the unloaded state of the endless sling, the inner sheath and the outer sheath have been shifted back to their original, low-tension position relative to one another so that the damaged locations at the inner sheath and at the outer sheath are no longer congruent on top of one another but may be offset relative to one another by even several centimeters.

SUMMARY OF THE INVENTION

It is the object of the invention to provide an endless sling that is equipped with a double tube of the above-mentioned type in which damage to the protective tube can be detected with greater certainty by a conventional visual check. This is accomplished by providing the sling with a plurality of binding elements positioned between the two longitudinal edges of the tubes and connecting the inner and outer sheaths together. The core of this teaching is that the relative displaceability of outer sheath and inner sheath of the double tube is limited in the regions disposed between the longitudinal connecting edges to such an extent that damage that occurred under load to not only the outer sheath but at the same location also to the inner sheath can be detected during the customary visual check in the unloaded state. The subject matter of the invention is further distinguished by its important advantage that the penetration of larger dirt particles, such as chips or trash, will become much more difficult or even avoided if only the outer sheath is damaged. Such dirt particles may lead to damage of the inner sheath over medium or longer periods of time and may even penetrate into the interior space of the inner sheath that contains the fiber strands at locations where the outer sheath is not damaged at all and which consequently are not available for a visual check.

The basic concept of the invention may also be expressed in such a way that the space between an inner sheath and an outer sheath, which in the conventional double tube is defined only by the longitudinal edges of the tube fabric but which is not otherwise partitioned, is divided, similarly to the configuration of a ship's hull, into individual more or less tightly sealed-off chambers, with it being possible without problems from a textile technology aspect to set the strength of the chamber walls, and thus the remaining relative mobility between inner and outer sheath, to the desired degree.

Typically, the chambered tube has chambers oriented in the longitudinal direction of the tube or in the direction of the warp threads of the protective tube. The chambered tube chambers are oriented in the direction of the weft threads. A mixed configuration is of course also conceivable in that longitudinally oriented chambers do not extend unlimitedly over the entire length of the tube or the entire circumference of the endless sling, respectively, but are limited in their longitudinal extent in the manner of the transverse chambers.

The binding elements for forming such longitudinal chambers as well as the mentioned transverse chambers can be produced, from a textile technology point of view, for example, by a binding warp or by tying on or interlacing, respectively.

BRIEF DESCRIPTION OF THE DRAWINGS

The invention will now be described in greater detail with reference to embodiments thereof that are illustrated in the drawing figures, in which:

FIG. 1 is a perspective view of the single-layer tube of a conventional endless sling; FIG. 1*a* shows a section of the fabric from FIG. 1 in a partially enlarged view;

FIG. 2 and 2*a* are views analogous to FIG. 1 and FIG. 1*a* of the double tube of an endless sling;

FIGS. 3 and 3*a* are views analogous to FIG. 1, FIG. 1*a*, FIG. 2 and FIG. 2*a* of a protective tube equipped, according to the invention, with longitudinal chambers between an inner sheath and an outer sheath;

FIG. 4 is a cross-sectional view in the direction of the warp threads of the tube fabric according to the invention approximately as it exists at the end of the weaving process;

FIG. 5 is a cross-sectional view seen along section line V—V of FIG. 3 in the direction of the warp threads of the protective tube showing the complete endless sling with inserted fiber strands;

DESCRIPTION OF THE PREFERRED EMBODIMENT

Figure 6:
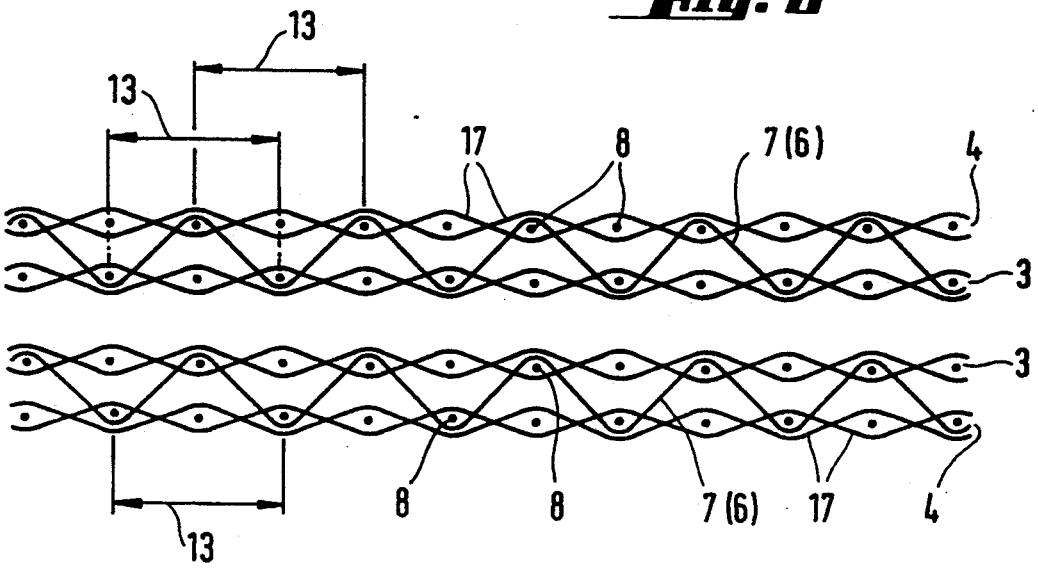
FIG. 6 is a sectional view seen along section line VI—VI of FIG. 3 in the direction of the weft threads of the protective tube, showing a binding weft as the binding element between the inner and outer sheaths.

Fiber strands constitute the load-bearing core of the endless sling. The textile protective tube 2 surrounding them is a double tube having an inner and an outer fabric layer on either side of the fiber strands 1 so as to form an inner sheath 3 and an outer sheath 4. From a textile technology aspect, the double tube 2 is a four-layer tubular fabric, with the two outer edges 5 of the inner sheath 3 and the outer sheath 4 present on either side of fiber strand 1 being all connected together by way of a textile binding. From a weaving technology aspect, this double tube can be called a four-layer fabric in which the individual fabric layers are inherently connected only in the region of the two longitudinal outer edges 5 (see "Gewebetechnik" [Fabric Technology] published by VEB Fachbuchverlag, Leipzig, 1968, pages 437 et seq, particularly FIG. 842).

Figure 10:
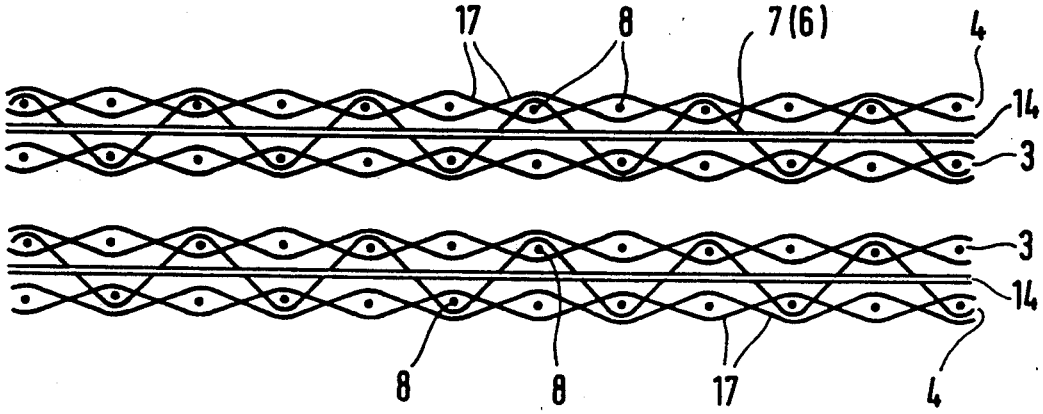
FIG. 10 is a sectional view along section line X—X of FIG. 8, seen in the direction of the weft threads, of the protective tube equipped with a binding chain as the binding means.
Figure 13:
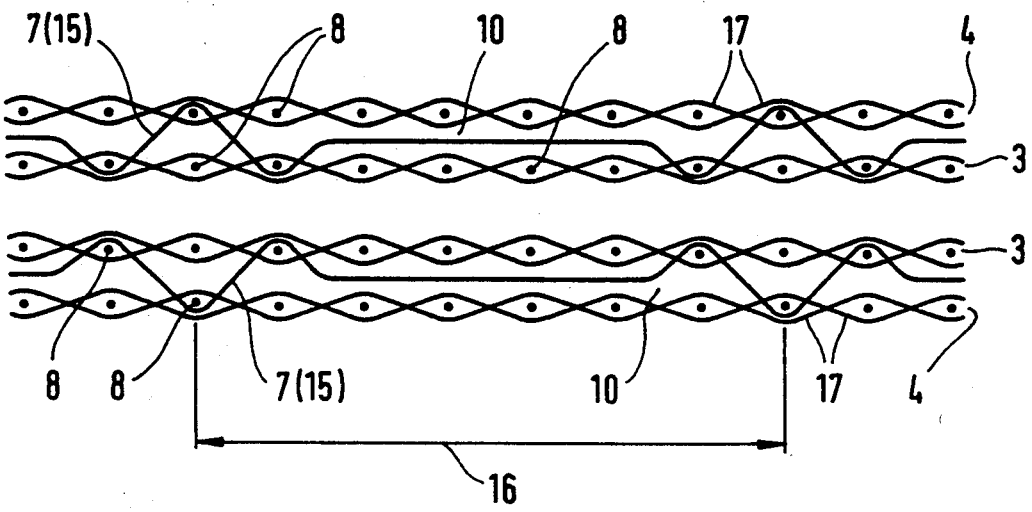
FIG. 13 is a sectional view along line XIII—XIII of FIG. 12 in the direction of the weft threads of a protective tube that is equipped with a binding warp as the binding means between the inner and outer sheaths.

According to the invention, the inner sheath 3 and the outer sheath 4 are connected with one another by additional binding elements 6 disposed between the two outer edges 5. The additional fabric bindings, namely binding elements 6, may be given so much slack that under a load being hoisted they permit a certain relative mobility between the fabric layers they connect, namely between inner sheath 3 and outer sheath 4. This can be accomplished most easily with the method of a binding warp 7 as shown in FIGS. 6, 10 and 13. Here, a combination of the tension of the binding warp during weaving and a regular connection length, for example, with the third or fourth weft of the outer fabric layers or of the two outer sheaths 4, respectively, a slight slack can be realized. With a very tightly tensioned binding warp, the mutually connected fabric layers would push against one another very strongly. If instead the binding warp is held very slack during weaving, a noticeably looser weave is produced between the two layers. The binding warp ("Gewebetechnik" [Fabric Technology], pages 193; 439) is an additional, separate warp thread system in addition to warp threads 17, and which connects the layers to be connected by crossing over their weft threads 8 and forming loops.

Figure 7:
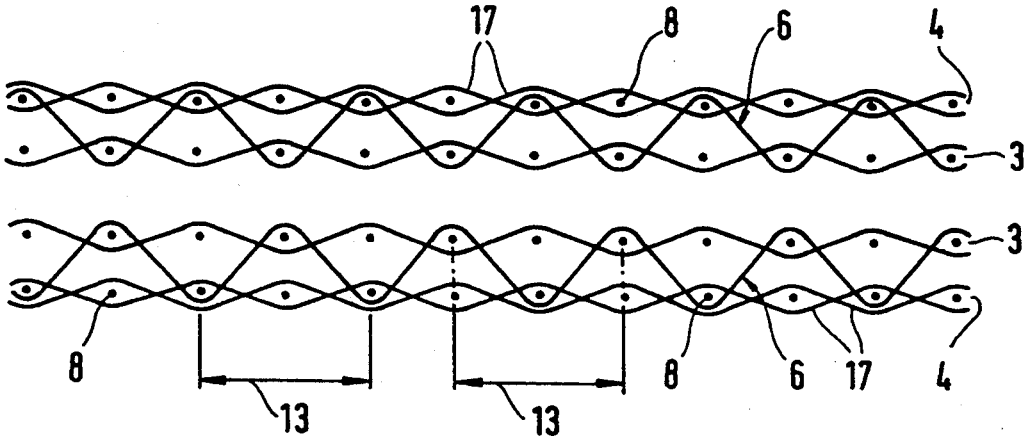
FIG. 7 is a sectional view analogous to FIG. 6 but with the weft threads tied in or interlaced as the binding element, requiring no additional, separate warp thread system.
Figure 8:
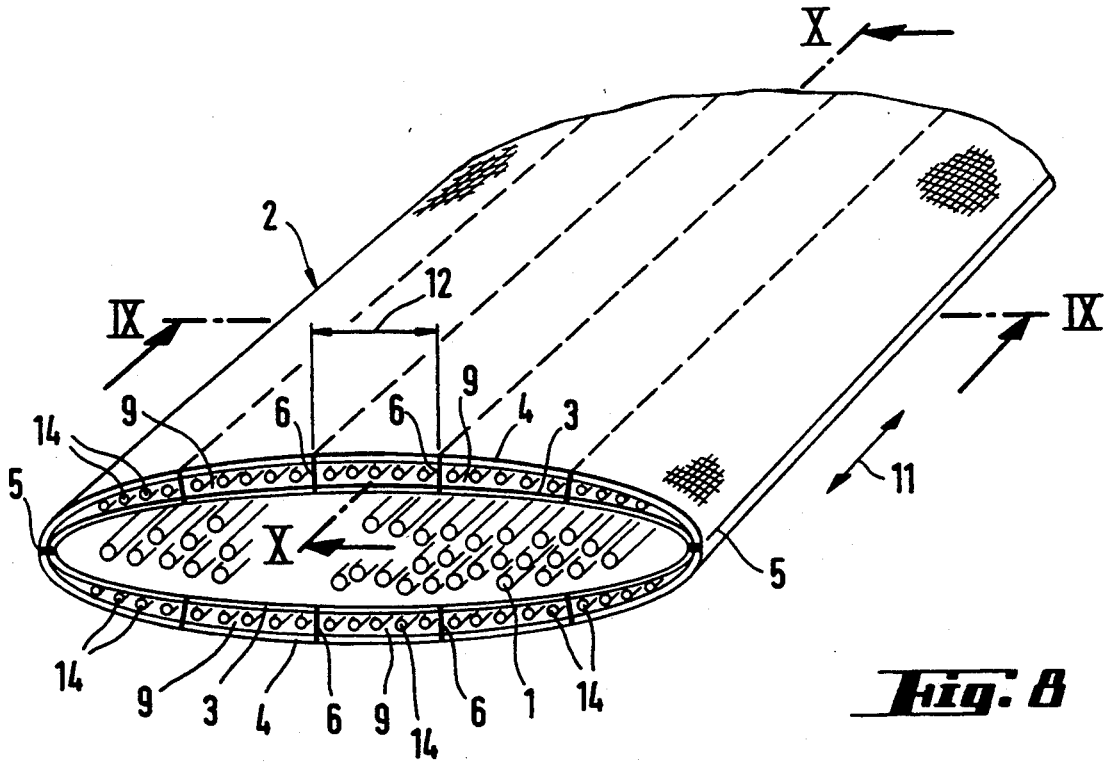
FIG. 8 is a perspective view of a longitudinally chambered tube analogous to FIG. 3 with stalk-like threads inserted in the longitudinal chambers.
Figure 9:
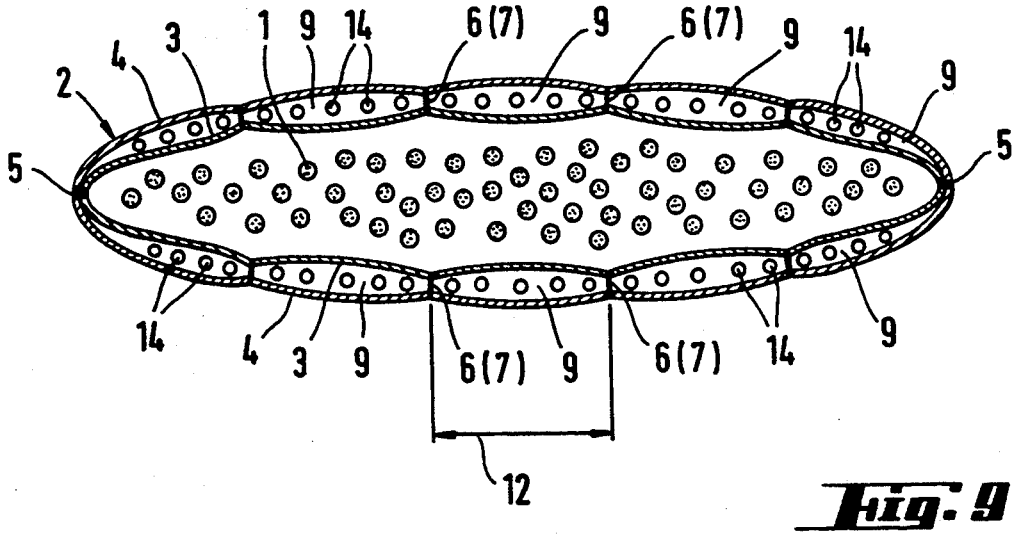
FIG. 9 is a cross-sectional view in the direction of the warp threads of an endless sling equipped with a protective tube according to FIG. 8 (direction of section line IX—IX in FIG. 8)
Figure 11:
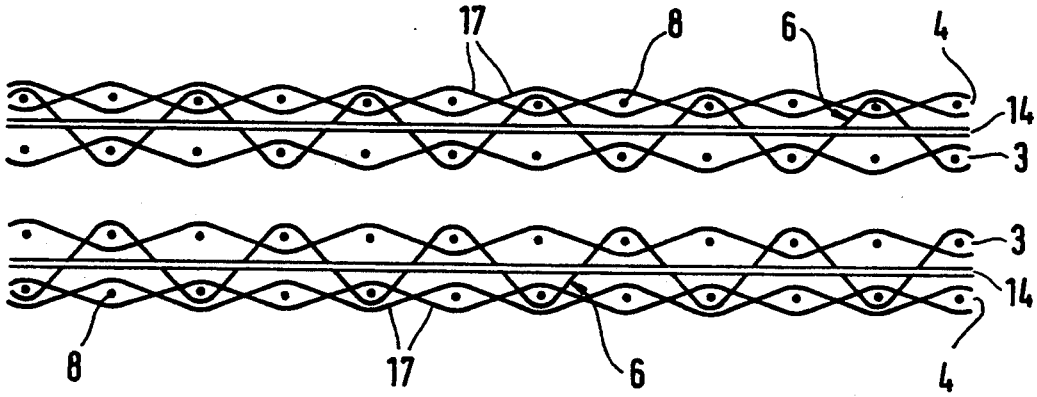
FIG. 11 is a sectional view analogous to FIG. 10 but with tying on or interlacing as the binding means between the inner and outer sheath.
Figure 14:
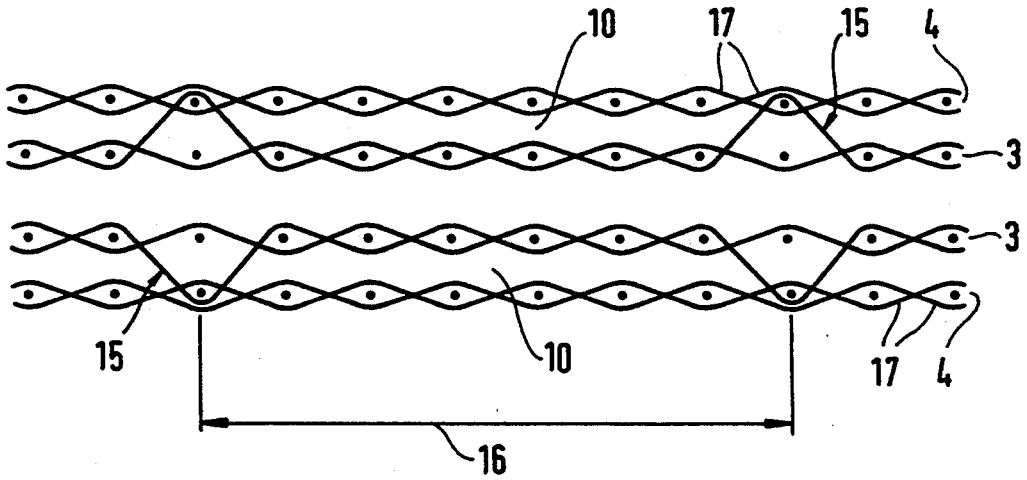
FIG. 14 is a longitudinal sectional view analogous to FIG. 13 but with interlacing as the binding means between inner and outer sheaths.

However, the binding elements 6 may also be formed by tie-ins or interlacing, respectively, in which case no additional, separate warp thread system is required (FIGS. 7, 11 and 14). In this case, an already existing warp thread of preferably an invisible layer, namely the two inner sheaths 3, is used for this purpose. The warp thread from these sheaths is regularly guided over the weft thread 8 of the fabric layers forming the two outer sheaths 4 and then underneath the weft thread 8 of the fabric layers forming the inner sheaths 3.

Figure 12:
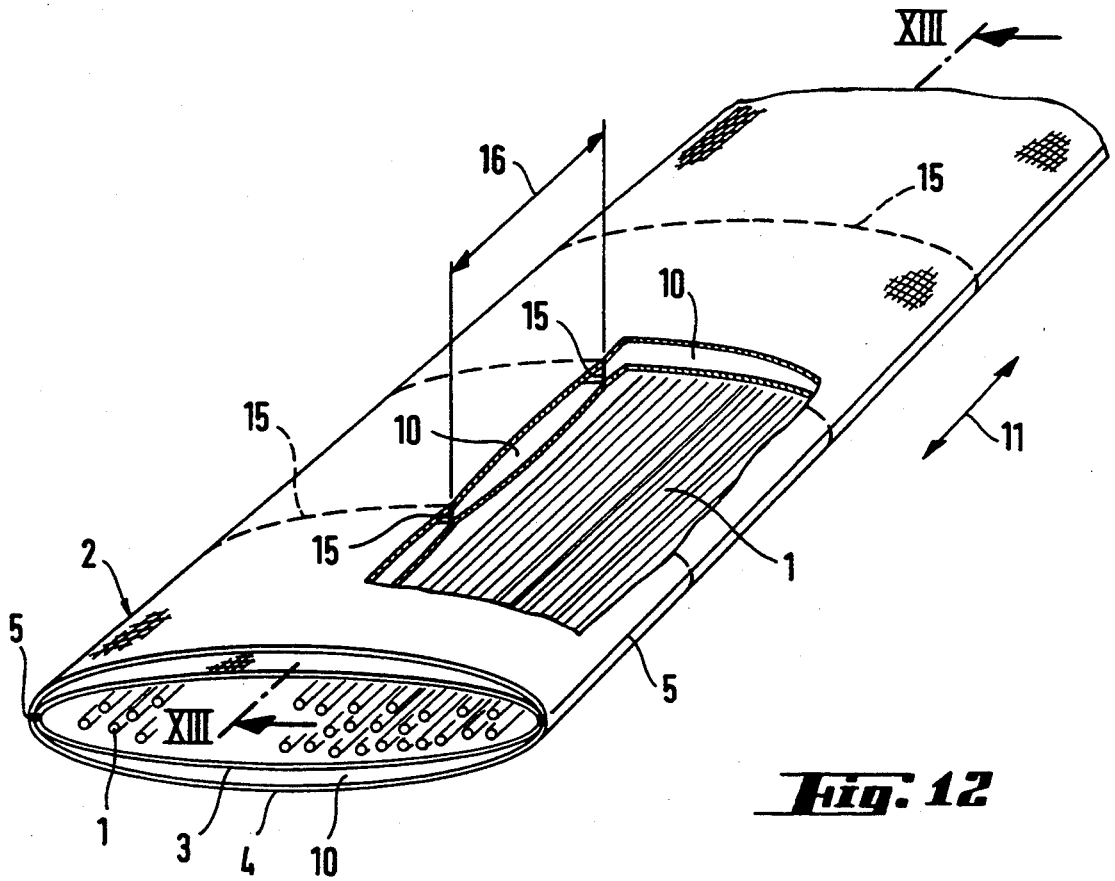
FIG. 12 is a perspective view of a protective tube according to the invention in which the chambers, as transverse chambers, extend essentially in the direction of the weft threads.

Binding elements 6 divide the spaces between inner sheath 3 and outer sheath 4 into a plurality of separate chambers. Depending on the orientation and configuration of the bindings, longitudinal chambers 9 (FIGS. 3–11) or transverse chambers 10 (FIGS. 12–14) may be formed in this way, with the terms "longitudinal" and "transverse" being used with reference to the direction 11 of the warp threads 17 of the tubular fabric as the longitudinal direction.

Longitudinal chambers 9 are created in that binding elements 6 maintain a constant spacing from the outer edges 5 of the tube and extend in the direction of the warp threads 11. If binding elements 6 are arranged in several juxtaposed rows, their mutual spacing 12 and the spacing from outer edges 5 is advisably constant. Thus it is ensured that longitudinal chambers 9 have a constant width.

It is not necessary that every weft thread of the tubular fabric form a binding element 6 to produce longitudinal chambers 9. However, in the manufacture of the tubular fabric, at least five successive passes (weft threads 8) should include a binding element 6. Advisably, the longitudinal spacing 13 between binding elements 6 in the direction 11 of the warp threads 17 of the tubular fabric is also kept constant.

In the embodiment according to FIGS. 8–11, stalk-type threads 14 which are not crossed with weft threads 8 are placed in longitudinal chambers 9 in order to pad them. To increase the padding effect, these stalk-type threads 14 may differ in their consistency from the consistency of the other polyester textile fibers. In particular, these may be smooth filament yarns, yarns having a puffy texture or soft-spun spun-fiber yarns.

To form transverse chambers 10, binding elements 6 are arranged in such a way that the lateral delimitations 15 of the transverse chambers have an orientation that extends in the weft direction (weft threads 8) of the tubular fabric.

The width between the lateral delimitations of the transverse chambers, which is called the binding repeat 16, is advisably between 1 and 40 cm. While the distance of successive binding elements 6 for the formation of longitudinal chambers 9 is relatively variable, it is recommended to form the transverse chambers 10 by as many connections as possible over the width of the fabric, so as to realize a good delimitation.

We claim:

1. An endless textile sling for lifting, comprising:

a textile protective cover comprising a first textile tube, and a second textile tube within said first textile tube to form a double tube structure, said first tube and said second tube being connected together by a binding means along two respective oppositely positioned longitudinal outer edges to form an inner sheath and an outer sheath;

a load-carrying core within said second textile tube and including a plurality of endless fiber strands; and a plurality of additional binding elements positioned between said two longitudinal outer edges and further connecting said inner and outer sheaths together.

2. An endless textile sling as defined in claim 1, wherein said binding elements include slack so that said inner and outer sheaths retain a relative mobility under a load to be lifted.

3. An endless textile sling as defined in claim 1, wherein said inner and outer sheaths are separated by a space, said binding elements partitioning said space into mutually separated chambers.

4. An endless textile sling as defined in claim 3, wherein said binding elements collectively define lateral delimitations of the respective chambers, said lateral delimitations each extending in a circumferential direction of said endless textile sling and in a direction of a warp thread of said textile protective cover.

5. An endless textile sling as defined in claim 4, wherein each binding element is a constant distance from said longitudinal edges.

6. An endless textile sling as defined in claim 3, wherein each said chamber has a constant chamber width.

7. An endless textile sling as defined in claim 3, wherein said textile protective cover includes a plurality of weft threads, and at least five successive weft threads include a binding element.

8. An endless textile sling as defined in claim 3, further comprising a plurality of discrete threads positioned within said chambers to create a padding effect.

9. An endless textile sling as defined in claim 8, wherein the consistency of said discrete threads differs from the consistency of textile fibers in said textile protective cover so as to increase the padding effect.

10. An endless textile sling as defined in claim 9, wherein said discrete threads comprise polyester.

11. An endless textile sling as defined in claim 9, wherein said discrete threads comprise one of a smooth filament yarn, puffy texture yarn, and soft-spun spun-fiber yarn.

12. An endless textile sling as defined in claim 3, wherein said binding elements collectively define a lateral delimitation of the respective chambers, said lateral delimitation extending in a direction of a weft thread of said textile protective cover.

13. An endless textile sling as defined in claim 12, wherein each said chamber has two lateral delimitations defining a chamber width between about 1 to 40 cm.

14. An endless textile sling as defined in claim 12, wherein said binding elements of a delimitation are successively arranged, one behind the other, over a width of said textile protective cover.

15. An endless textile sling as defined in claim 1, wherein each binding element is separated from an adjacent binding element in a longitudinal direction by a constant longitudinal space.

16. An endless textile sling as defined in claim 1, wherein said binding elements comprise a binding warp.

17. An endless textile sling as defined in claim 1, wherein said binding elements comprise one of a tie-in and interlaced connection.

* * * * *